US009249613B2

(12) United States Patent
Kristensen et al.

(10) Patent No.: US 9,249,613 B2
(45) Date of Patent: Feb. 2, 2016

(54) METHOD FOR MAKING A WINDOW AND AN OPENING WINDOW

(75) Inventors: Lars Kristensen, Østbirk (DK); Kristian Ørnsvig Nielsen, Hornsyld (DK); Peter Sønderkær, Horsens (DK)

(73) Assignee: VKR Holding A/S, Hoersholm (DK)

( * ) Notice: Subject to any disclaimer, the term of this patent is extended or adjusted under 35 U.S.C. 154(b) by 141 days.

(21) Appl. No.: 13/138,424

(22) PCT Filed: Feb. 3, 2009

(86) PCT No.: PCT/DK2009/050033

§ 371 (c)(1),
(2), (4) Date: Oct. 18, 2011

(87) PCT Pub. No.: WO2010/088906

PCT Pub. Date: Aug. 12, 2010

(65) Prior Publication Data

US 2012/0023828 A1 Feb. 2, 2012

(51) Int. Cl.
*E06B 3/66* (2006.01)

(52) U.S. Cl.
CPC ..... *E06B 3/6621* (2013.01); *Y10T 29/49826* (2015.01)

(58) Field of Classification Search
USPC ..... 49/397, 381, 398, 399, 400; 296/146.16, 92, 190.1, 216.02, 218
See application file for complete search history.

(56) References Cited

U.S. PATENT DOCUMENTS 994,196 A * 6/1911 Reddick ..... 16/245
1,257,572 A * 2/1918 Appleby ..... 16/266
1,903,379 A * 4/1933 Hall ..... 16/367
1,934,074 A * 11/1933 Kubler ..... 49/399
2,105,705 A * 1/1938 Spathelf ..... 49/398
2,314,337 A * 3/1943 Gessler ..... 16/379
2,606,346 A * 8/1952 Hassell ..... 49/192
2,705,415 A 4/1955 Livesay
2,910,154 A * 10/1959 Hammitt et al. ..... 49/399
3,320,699 A * 5/1967 Carson et al. ..... 49/388
3,385,003 A * 5/1968 Owen ..... 49/504
3,724,666 A * 4/1973 Johnson ..... 210/167.1
3,791,074 A * 2/1974 Waffenschmidt ..... 49/399
4,104,828 A * 8/1978 Naslund et al. ..... 49/399
4,119,340 A * 10/1978 Wolfe ..... 296/215
4,445,589 A * 5/1984 Longenecker ..... 182/76
4,684,167 A * 8/1987 Newmayer ..... 296/202
4,974,366 A * 12/1990 Tizzoni ..... 49/504
4,996,794 A * 3/1991 Daniel ..... 49/250

(Continued)

FOREIGN PATENT DOCUMENTS

CH 369 277 A 5/1963
CN 87206502 9/1987
DE 29607923 9/1996

*Primary Examiner* — Katherine Mitchell
*Assistant Examiner* — Shiref Mekhaeil
(74) *Attorney, Agent, or Firm* — Merek Blackmon & Voorhees LLC

(57) ABSTRACT

The invention relates a method for making a window, where the sash is connected to the frame by a pair of hinges, each comprising a first hinge part connected to the sash and a second hinge part connected to the frame. The sash is made from a plastic material by molding, and that one or more functional elements are attached to the sash during the molding thereof. The functional elements can include a stay arm having a base member, which is attached to the sash bottom member, and the first hinge parts. Also, the frame may be made by molding.

4 Claims, 3 Drawing Sheets

(56) References Cited

U.S. PATENT DOCUMENTS

| | | | | | |
|---|---|---|---|---|---|
| 5,018,242 | A | * | 5/1991 | Guy et al. | 16/228 |
| 5,050,928 | A | * | 9/1991 | Bohm et al. | 296/216.09 |
| 5,070,590 | A | * | 12/1991 | Fujioka et al. | 29/527.2 |
| 5,127,568 | A | * | 7/1992 | Unuma et al. | 226/74 |
| 5,193,308 | A | * | 3/1993 | Davidian | 49/381 |
| 5,402,552 | A | * | 4/1995 | Chen | 16/228 |
| 5,568,831 | A | * | 10/1996 | Blackwell | 160/98 |
| 5,584,157 | A | * | 12/1996 | Sun | 52/656.4 |
| 5,694,665 | A | * | 12/1997 | Strickland et al. | 16/238 |
| 5,799,370 | A | * | 9/1998 | Davidian et al. | 16/236 |
| 5,806,144 | A | * | 9/1998 | Fries | 16/246 |
| 5,934,030 | A | * | 8/1999 | McDonald | 52/204.1 |
| 6,138,341 | A | | 10/2000 | Barroero et al. | |
| 6,789,293 | B2 | * | 9/2004 | Habegger et al. | 16/343 |
| 7,516,517 | B2 | * | 4/2009 | Fries | 16/246 |
| 7,533,495 | B2 | * | 5/2009 | Teramoto et al. | 49/441 |
| 7,581,289 | B2 | * | 9/2009 | Chang | 16/228 |
| 2006/0175866 | A1 | * | 8/2006 | Dankert et al. | 296/146.16 |

* cited by examiner

METHOD FOR MAKING A WINDOW AND AN OPENING WINDOW

FIELD OF THE INVENTION

The invention relates to a method for making a window comprising a sash and a frame, each comprising a top member, a bottom member and two side members, where the sash is connected to the frame by a pair of hinges, each comprising a first hinge part connected to a side member of the sash and a second hinge part connected to a side member of the frame. The invention further relates to a window of this kind.

Such windows are known in numerous forms, an example being the cast iron windows used in traditional northern European tile roofs for providing light and ventilation in the attic. These windows are made simply by casting a sash, putting in sheets of glass and fixing them, typically by means of a putty rabbet. The first hinge parts are formed from the cast iron in one with the sash and a base member for attachment of a stay arm may be formed in the same way.

The cast iron windows, however, have poor insulating properties and more modern alternatives have therefore been provided. In these new windows the pane is either inserted in aluminium profiles having a U-shaped cross-section or aluminium glazing profiles are attached to sash members so that they project over the edge of the pane. Hinge parts, stay arms etc. are attached to the sash by riveting or by means of screws and will often be supplemented by other accessories not common to the traditional cast iron windows. These new windows have proven to have markedly improved insulating properties, but suffer from being relatively costly due to the large number of different components needed and the resulting complexity of the process of manufacture.

SUMMARY OF THE INVENTION

It is therefore the object of the invention to provide a method of making a window, which eases the manufacture without jeopardizing the insulating properties.

This is achieved with a method where the sash is made from a plastic material by moulding, and where one or more functional elements are attached to the sash during the moulding thereof. By moulding the sash from a plastic material it is possible not only to avoid the thermal bridges, which are the primary drawback of using the traditional cast iron windows; due to the relatively low moulding temperature it is also possible to attach necessary functional elements such as the pane, hinges, coverings, screenings devices or even insulation at the same time as making the sash. This not only leads to ease of manufacture but has the added advantage of allowing a particularly good attachment with a minimum of joints. In addition, the subsequent attachment of hinges, stay arms, glazing lists and like component necessary with traditional windows is avoided.

If choosing to attach the pane to the sash by embedding it in the plastic material it will often be appropriate to provide some kind of safety device to retain the pane in the event of the plastic loosing its load-bearing capacity. This may for example happen when the plastic becomes soft during a fire or may result from a general deterioration of the material due to wear, exposure to UV radiation, inappropriate cleaning or the like. This retaining of the pane may for example be achieved by providing a metal inlay in the sash, possibly connected to the hinges, but other materials, such a ceramics, glass or carbon fibres or different polymers, may also be employed.

Another option is to add a fire-retardant to the plastic, but this will of course not prevent deterioration due to other influences.

It is preferred that the functional elements are attached to the sash solely by being embedded in the material thereof, but it is of course also possible to fortify connections by means of screws or the like. In this, the term "embedded" is intended to cover both a situation, where the functional element has one or more exposed surfaces, and a total encasement thereof.

In one embodiment, the functional element(s) include a stay arm having a base member, which is attached to the sash bottom member; in another the first hinge parts. The combination of these particular functional elements results in a window resembling the traditional cast iron window and which is therefore particularly suited for renovation purposes.

The frame may of course also be made by moulding, in which case additional functional elements, such as the second hinge parts, flashings etc. may be embedded therein, just as described for the sash.

When making the sash and possibly also the frame my moulding it is possible to design the mould such that at least one surface of the sash, which is visible in the mounted state of the window, is given desired surface properties. An obvious example would be to make the surface structure resemble that of a traditional cast iron window, thus making the window particularly suited for use in renovation projects. Other examples could be to make the surface particularly resistant to fouling or to prepare it for the mounting of cladding or covering members.

Hinges come in numerous designs, but in the method according to the invention it is advantageous to use some, where the first and/or second hinge parts each comprises a first and a second leg, which are substantially perpendicular to each other, and where the first leg is arranged in parallel with a side member of the sash or frame, respectively, while the second leg is arranged to project towards the exterior in the mounted state of the window. The second leg may then be used for interconnection with the other hinge part. In a preferred embodiment, the first and second hinge parts are interconnect by a pin located on or projecting through the second leg of a hinge part, and said pin defining a hinge axis, about which the sash pivots when the window is opened or closed. In this way, the hinge axis will be located at a level somewhat above the first leg of the hinge part, which facilitates the operation, i.e. opening and closing, of the window. Moreover, the window will appear very much like a traditional cast iron window.

Presently, the embodiment where both the first and second hinge parts comprise two perpendicular legs is preferred.

Throughout this text the terms "interior" and "exterior" is used to indicate the orientation, when the window is mounted in a building, i.e. the interior side of a component is the side facing the interior of the building. Similarly, the terms "inner" and "outer" is used to indicate whether a particular component faces into the space defined by the sash or away from this, i.e. the outer side of a sash member is the one facing away from the pane.

One functional element may in principle serve more than one purpose. An example would be to use a hinge, where the first leg of one or more hinge parts extends substantially along the entire length of the side members to which it is attached. In this way the hinge part may additionally serve as a stiffening and/or strengthening member, either improving the properties of the side member as a whole or enabling it to receive screws or the like for fastening additional functional elements.

It is to be understood, that the fact that the hinge parts has two legs, which are substantially perpendicular, does not limit the embodiment to L-shaped designs. On the contrary, the design of the hinge parts may be relatively complex with different parts located in several different planes and at different levels. An example of this and of others detail of the invention will be described below with reference to the drawing, in which:

DETAILED DESCRIPTION OF THE INVENTION

Figure 1:
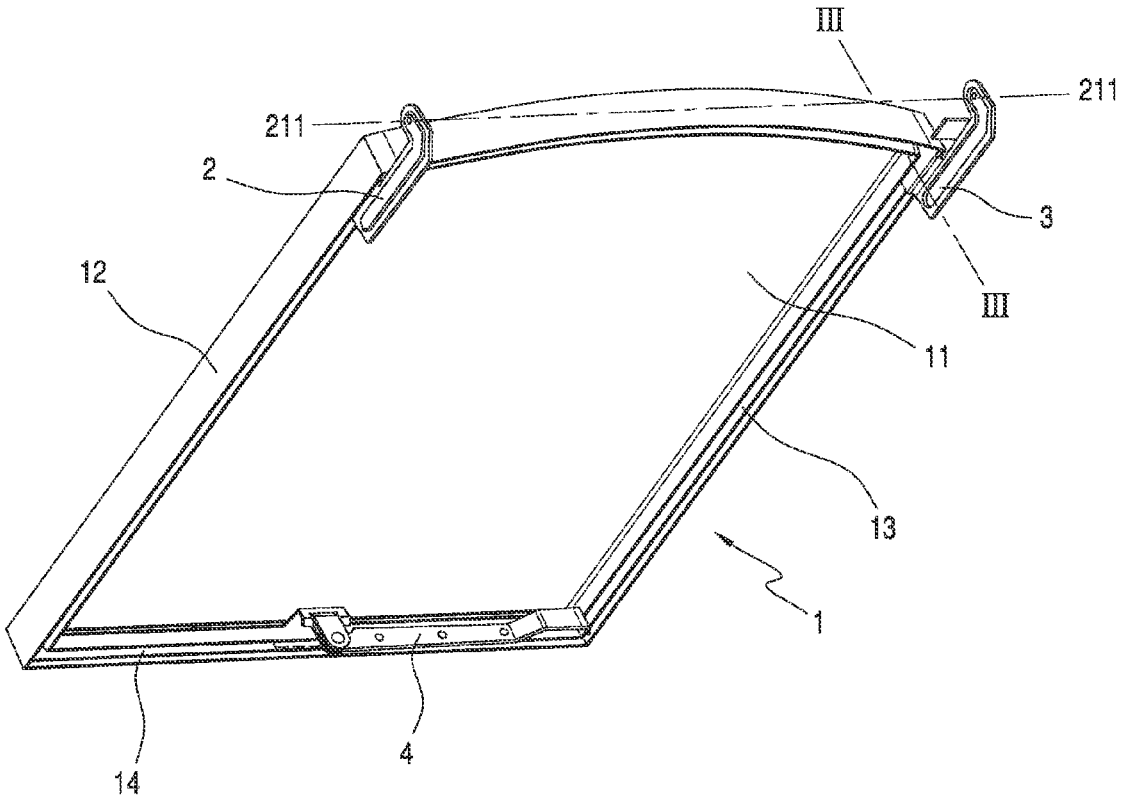
FIG. 1 shows a sash for an opening window according to the invention.

A sash 1 for a top-hung window according to the invention is shown in FIG. 1. This sash is of a relatively simple construction with first hinge parts 2,3 arranged at the uppermost ends of the sash side members 12,13. A stay arm 4 for opening the window is attached to the bottom member 14 of the sash and intended to cooperate with a pin on the bottom member of a stationary frame (not shown) for keeping the window in an open position.

In this reference will be made to top, bottom and side members of the sash. This is not to be understood as if the sash must be composed of separate members joint to each other. On the contrary, it preferred that the sash is moulded in one piece.

Figure 2:
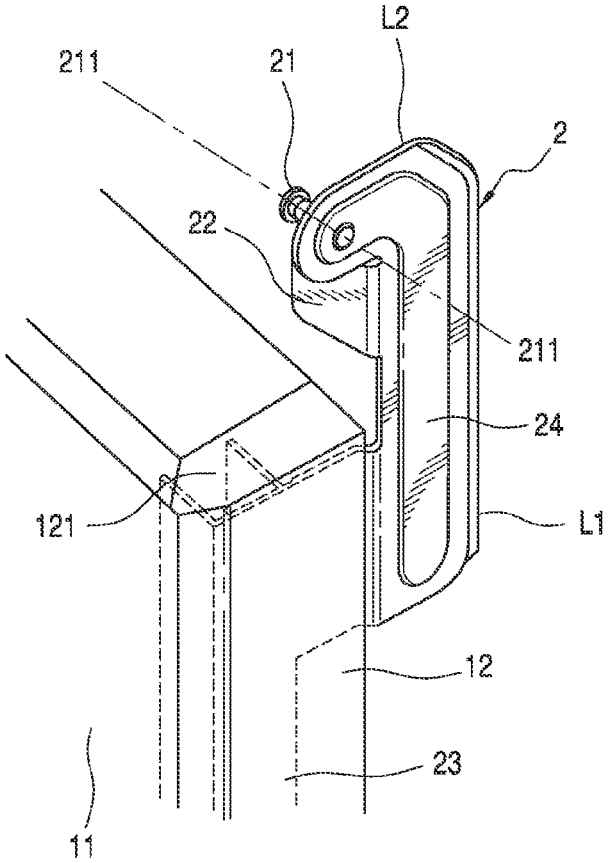
FIG. 2 shows a first hinge part of the sash in FIG. 1.

The first hinge part 2, which will usually be made from plate metal, is shown in more detail and from another angle in FIG. 2. The pin 21 is intended for connecting the first hinge part 2 to a corresponding second hinge part (not shown) on the stationary frame, thus defining a hinge axis 211, and the flap 22 is intended to serve as a burglary protection preventing access to the second hinge part, when the window is closed. As both of these functions are well known to the skilled person they will not be described in closer detail here.

Figure 3:
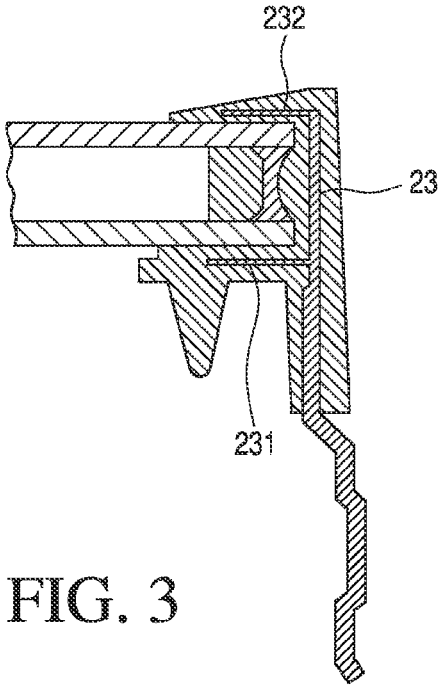
FIG. 3 shows a cross sectional view of the hinge part along the line III-III.

Special to the invention is that the first hinge part 2 is embedded in the material of the sash 1 as may be clearly seen in the cross-sectional view of FIG. 3. The sash itself is made from a plastic material and has been moulded such that it embraces the rim of the pane 11 entirely. This total embracement gives a particularly good hold of the pane, but other embodiments, where the material of the sash is only in contact with e.g. the exterior side of pane may also be advantageous. Moreover, the sash may be formed in two or more steps, where for example a sash part moulded in a first step is in contact with one side of the pane and a sash part moulded in a later step is in contact with the edge face and/or another side of the pane.

Different functional elements, such as drains or absorbing materials for keeping water away from the edge of the pane, may be provided in the sash during the moulding thereof. A drain may for example be embodied as a cavity extending inside the sash members in the longitudinal direction thereof, preferably adjacent to the edge of the pane. If the inner cavity is located in a side member it may simply end in an opening in its lower end, but the cavity may also be connected to an outer surface of the sash member by means of branched off channels.

Other examples of elements, which could be added during moulding are electrical wiring, passages for curtain cords, insulation and reinforcement.

In the embodiment shown in the drawing the first hinge parts 2,3 project to the interior in relation the plane of the sash. This embodiment is intended for windows where the sash and stationary frame is of substantially the same size, the sash laying "on top" of the frame in the closed state of the window, and the main section 24 of the first hinge part thus comes to lay along the outer side of the side member of the frame. If working with a different window structure, the first hinge part may in stead project trough the upper end 121 of the sash side member.

Figure 4:
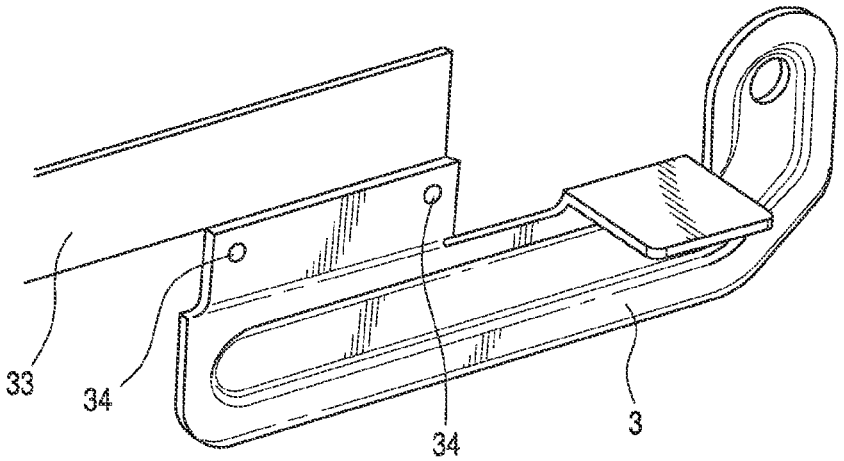
FIG. 4 shows a first hinge part before being attached to the sash.

As shown in FIGS. 1, 2 and 4 the first hinge parts may be said to have the overall shape of an L, where one leg L1 is parallel to the sash side member, while the other leg L2 projects towards the exterior. The hinge pin 21 is located at the free end of the projecting leg L2 to keep the hinge axis at a distance above the plane of the load-bearing structure, which will typically be a roof. This design of the hinge is structurally very simple and reliable, but other designs are of course imaginable.

Figure 6:
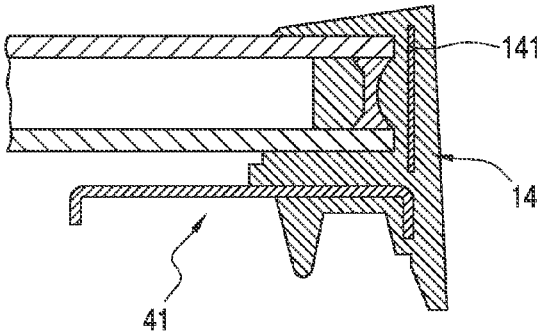
FIG. 6 shows a cross sectional view of the base member in FIG. 5 along the line VI-VI.

The pane shown in FIGS. 3 and 6 is a traditional insulating pane but it is to be understood that single layer panes or three layer panes may also be employed as may sheet elements of other materials than glass, both transparent and non-transparent. Preferred non-glass materials are polycarbonate and Plexiglas (also known as Perspex). The pane may also be provided with added elements (not shown) such as films blocking solar radiation and/or radio frequencies, photovoltaic elements or films, rain sensors or the like.

The section 23 of the hinge part 2, which is embedded in the sash, must be big enough to ensure that the forces transmitted from the pane to the stationary frame via the hinges does not disrupt the material of the sash.

As may be seen from both FIG. 1 and FIG. 2, a sash of a relatively slim design is desired. Depending of the material used, this may necessitate a reinforcement of the sash, which may advantageously be achieved by letting the embedded section 23 of the sash extend substantially along the entire side member 12 of the sash. An embodiment 3 suitable for this use, but being mirror-inverted and intended for the other side of the window, is shown in FIG. 4, where some of the length of the embedded section 33 has, however, been cut off.

The reinforcing section 23,33 of the first hinge part 2,3 may also be provided with flaps projecting inwards underneath and/or above the rim of the pane as indicated by the dotted lines 231,232 in FIG. 3. If the sash material should become soft in the event of fire, the flaps, which are connected to the hinge and thus to the load-bearing structure, will retain the pane. The flaps need not extend over the entire length of the sash side member 12,13, two or three locale flaps may suffice depending on the size of the window and the type of pane used. The flaps may be made in any convenient manner, for example by bending out parts of the embedded section 23,33.

As may also be seen from FIG. 4, the first hinge parts may be composed of two sections, which have here been joined by means of rivets 34. Other means of joining the two sections could be welding or gluing, but it is also envisaged to provide the embedded section with a snap fastener, so that the projecting section of the first hinge part can be easily added at a later point in time, possible at the construction site, where the window is to be mounted. Alternatively, the first hinge parts could be provided in a folded-back position and later be swung or pivoted to their position of use. At present it is, however, preferred to use a unitary element, with no joints.

Figure 7:
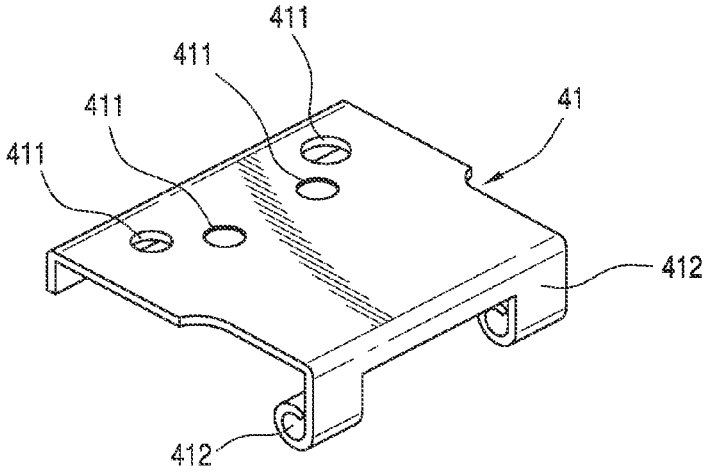
FIG. 7 shows the base member in FIG. 5 before being attached to the sash.
Figure 5:
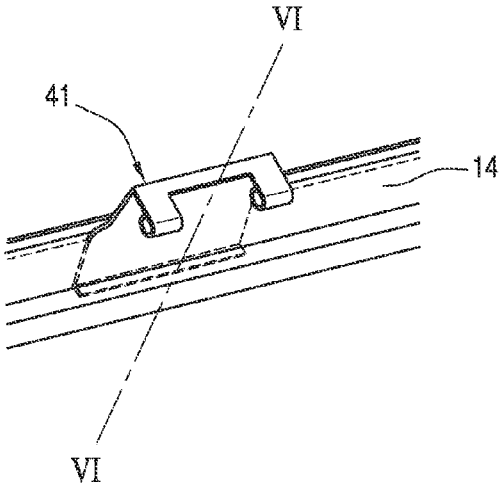
FIG. 5 shows the base member for the stay arm on the sash in FIG. 1.

Turning now to FIGS. 5-7, these show an embodiment of a base member 41 for a stay arm 4. As may be seen in FIGS. 5 and 6, the base member is embedded in the material of the sash bottom member 14. During moulding, the material of the sash will penetrate through the holes 411 in the base member, leading to an excellent interconnection, but the holes may also be used to receive screws or like fastening means (not shown). The turned down sections 412 of the base member is used for interconnecting it with the stay arm itself via a simple gudgeon joint, but other pivoting joints may of course be used.

In the embodiment shown in FIG. 6, the sash bottom member 14 is provided with a reinforcing element 141, which is separate from the base member 41, but it will also be possible to form these two as a single element. Also, such an element could be provided with retaining flaps embracing the pane as described for the first hinge parts above.

The examples described above are based mainly on the use of traditional metal hinges and stay arm. Other materials such as ceramics, fibers, polyurethane, epoxy etc. may however also employed, possibly in combination. An example would be to encase hinges and other metal parts, which are to project from the sash and/or frame, in plastic to minimize the transmission of heat there trough. The mechanical properties of the different parts should, however, not be compromised.

In this only a few advantageous embodiments of construction of the hinge and stay arm have been described and the skilled person will be able to envisage numerous alternatives within the scope of the claims.

The invention claimed is:

1. A window sash comprising a top member, a bottom member and a first side member and a second side member, where the sash includes a pair of hinges, each of said pair of hinges comprising a first hinge part connected to the sash, wherein the sash includes one or more functional elements that are molded therein such that said one or more functional elements are embedded in the sash to form a single integral monolithic piece, said one or more functional elements including the first hinge parts, wherein one of the first hinge parts is located near a first joint where the first side member joins the top member and the other first hinge part is located near a second joint where the second side member joins the top member so as to form a top-hung window, that, in each hinge, the first hinge part comprises a first and a second leg, which are perpendicular to each other, and where the first leg is arranged in parallel with one of said first and second side members and the second leg is arranged to project outwardly, where the first leg of the first hinge part is arranged to extend substantially along the entire length of the first or second side member to which it is attached from the top member to the bottom member, and that in each hinge, the first hinge part comprises one or more flaps projecting from a plane defined by the first leg and the second leg.

2. A window sash according to claim 1, wherein the sash retains a window pane having an edge and the window sash further including pins defining a hinge axis and said flaps project inwards at the edge of the pane.

3. A window sash according to claim 1, where a base member of a stay arm is embedded in the sash bottom member.

4. A window sash according to claim 1, where the first hinge parts are embedded in the sash.

* * * * *